United States Patent [19]

Latenser

[11] Patent Number: 4,489,713

[45] Date of Patent: Dec. 25, 1984

[54] FLEXION-TRACTION BACK RELAXING SYSTEM

[76] Inventor: John F. Latenser, 604 Ridgewood Ave., Omaha, Nebr. 68114

[21] Appl. No.: 445,909

[22] Filed: Dec. 1, 1982

[51] Int. Cl.[3] ..... A61H 1/02

[52] U.S. Cl. ..... 128/71; 128/75; 5/443

[58] Field of Search ..... 128/25 R, 69–75, 128/84 C; 272/144, 145, 118, 93; 5/443

[56] References Cited

U.S. PATENT DOCUMENTS

| | | | |
|---|---|---|---|
| 2,631,582 | 3/1953 | Bensfield | 128/25 R |
| 3,659,594 | 5/1972 | Schwab | 128/69 |
| 3,800,787 | 4/1974 | Rush | 128/75 |
| 3,874,375 | 4/1975 | Penner | 128/75 |
| 3,984,101 | 10/1976 | Garza | 128/25 R X |
| 4,256,302 | 3/1981 | Keiser et al. | 272/144 X |
| 4,316,609 | 2/1982 | Silberman | 272/118 |
| 4,362,151 | 12/1982 | Cottrell | 128/75 |

FOREIGN PATENT DOCUMENTS

| | | | |
|---|---|---|---|
| 2328939 | 1/1975 | Fed. Rep. of Germany | 128/69 |
| 2639307 | 3/1978 | Fed. Rep. of Germany | 272/145 |

*Primary Examiner*—Robert A. Hafer
*Assistant Examiner*—Chris Coppens
*Attorney, Agent, or Firm*—Zarley, McKee, Thomte, Voorhees & Sease

[57] ABSTRACT

A back traction and relaxing system is disclosed adapted to be used on a patient lying on a supporting surface such as a hospital bed or the like. A frame is secured to the frame of the bed and extends over the patient. A first pulley is mounted on the frame approximately over the patient's waist and has a cable extending therearound and downwardly therefrom towards the patient. A gear motor is connected to the cable for longitudinally moving the cable relative to the pulley. A knee and ankle supporting mechanism is secured to the lower end of the cable and comprises a transversely extending knee support adapted to fit beneath the patient's knees. An elongated member is secured to the knee support and extends therefrom towards the patient's feet. A transversely extending ankle support is secured to the end of the elongated member and is adapted to be positioned over the patient's ankles. Upward movement of the cable by the gear motor causes the knee and ankle supporting mechanism to move upwardly thereby causing the patient's buttocks to be raised slightly from the bed thereby relaxing the patient's lower back area. The knee support pulls upwardly on the underside of the patient's knees while the ankle support prevents the patient's legs from disengaging from the knee and ankle supporting mechanism.

7 Claims, 5 Drawing Figures

FLEXION-TRACTION BACK RELAXING SYSTEM

BACKGROUND OF THE INVENTION

Many types of traction devices have been employed in an attempt to alleviate lower back pain. One type of traction device is illustrated in U.S. Pat. No. 3,800,787 which issued to Rush on Apr. 2, 1974. In the Rush device, the patient's calves are horizontally supported on a vertically movable support with the vertically disposed thighs of the patient being strapped to the movable support. The apparatus disclosed in Rush is not adjustable for various sizes of patients and does not provide a convenient means for restraining the patient's legs, below the knees, during upward movement of the support. Further, the Rush device is difficult to use and it is believed that prolonged use of the device, as recommended, might imperil circulation in the patient's legs, particularly in older patients.

Other types of traction devices and exercising devices have been described such as in U.S. Pat. Nos. 3,984,101; 3,874,375; 3,593,708; 3,850,165; 3,124,126; 3,659,594; and 4,103,681. All of the prior art devices suffer from the same drawbacks in that they are not convenient to use, are not maximally effective, and do not provide in a recumbent patient the proper vertical lifting pull to the thighs and consequent proper vertical lifting action on the pelvis so as to achieve right angle flexion traction at the lumbosacral joint with consequent optimal enlargement of the intervertebral foramina with consequent relief of low back pain and its attendant muscle spasm.

Therefore, it is a principal object of the invention to provide a flexion traction back relaxing system.

A further object of the invention is to provide an improved back pain relieving system.

A further object of the invention is to provide an improved back muscle relaxing system which in turn further alleviates the low back pain.

A further object of the invention is to provide a back relaxing system which is easily adaptable to a large majority of hospital beds, physiotherapy treatment tables, and home treatment situations.

A further object of the invention is to provide a back relieving and back muscle relaxing system including a supporting frame which is telescopic so as to be used with adjustable hospital beds.

A further object of the invention is to provide a flexion traction back relaxing system including a knee and ankle supporting mechanism which properly supports the knees and ankles of the patient.

Still another object of the invention is to provide a flexion traction back relaxing system for the relief of back pain which is easily controlled by the patient.

Still another object of the invention is to provide a flexion traction back relaxing system for the relief of back pain which is adjustable to various sizes of patients.

Still another object of the invention is to provide an improved back pain and back relaxing system which does not interfere with the circulation of the blood in the patient's lower legs.

These and other objects will be apparent to those skilled in the art.

SUMMARY OF THE INVENTION

Figure 1:
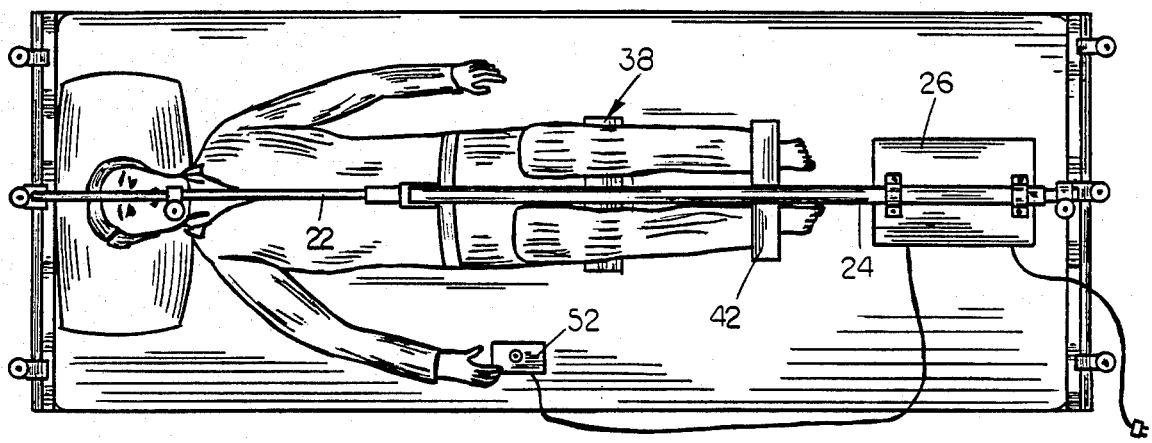
FIG. 1 is a top view illustrating the flexion traction back relaxing system of this invention mounted on a hospital bed.

A supporting frame is secured to a hospital bed or the like so as to extend over the patient. The supporting frame is length adjustable for use in those situations where the length of the bed changes should the patient adjust the contour of the bed. A gear motor is secured to the supporting frame adjacent either the foot or the head of the bed and is controlled by means of a control box located adjacent the patient. A cable extends from the gear motor and passes around a pulley mounted on the supporting frame approximately over the patient's waist. A knee and ankle supporting mechanism is secured to the cable and is designed to be positioned beneath the patient's knees and over the patient's ankles whereby upward movement of the knee and ankle supporting mechanism by the cable will cause the patient's thighs to be substantially vertically disposed and to slightly raise the patient's buttocks from the bed.

DESCRIPTION OF THE PREFERRED EMBODIMENT

The flexion traction back relaxing system of this invention is referred to generally by the reference numeral 10 and is designed to be secured to a conventional hospital bed 12 including a frame 14. Bed 12 illustrated in the drawings is of the adjustable type commonly found in hospitals wherein the length of the bed will vary depending upon the contour of the adjustable mattress portions. However, it should be noted that the apparatus of this invention will work equally as well on those beds in which the lengths do not change during the adjustment of the beds.

System 10 includes a supporting frame 16 including vertical supports 18 and 20 which are secured to the frame 14 of the bed. Pipe or shaft 22 extends horizontally from the upper end of support 18 and is telescopically received in a pipe or tube 24 which is secured to the upper end of support 20 and which extends horizontally therefrom.

Motor support 26 is secured to pipe 24 adjacent the either the foot or the head of the bed and has a conventional gear motor 28 mounted thereon including a cable drum 30 having cable 32 extending therefrom. Cover 33 covers gear motor 28. Cable 32 extends around pulley 34 which is mounted on pipe 24 as seen in the drawings. Preferably, pulley 34 is positioned on the pipe 24 so as to be located approximately over the belt or waist area of the patient. The position of pulley 34 is adjustable along pipe or shaft 22, or along pipe or tube 24.

Figure 3:
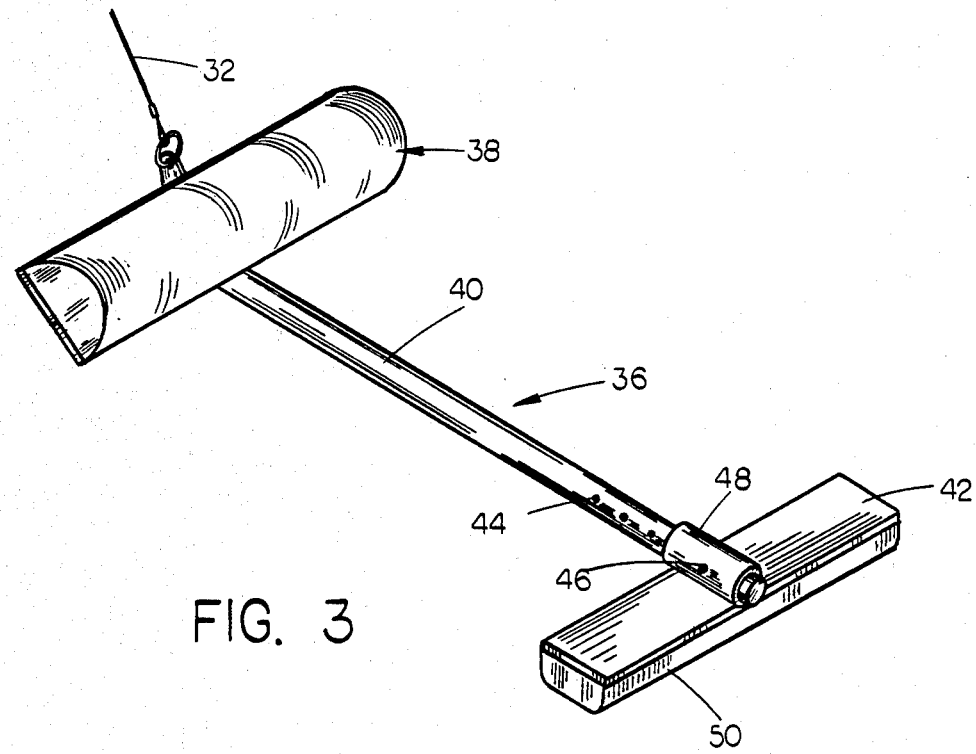
FIG. 3 is a perspective view of the knee and ankle supporting mechanism.
Figure 4:
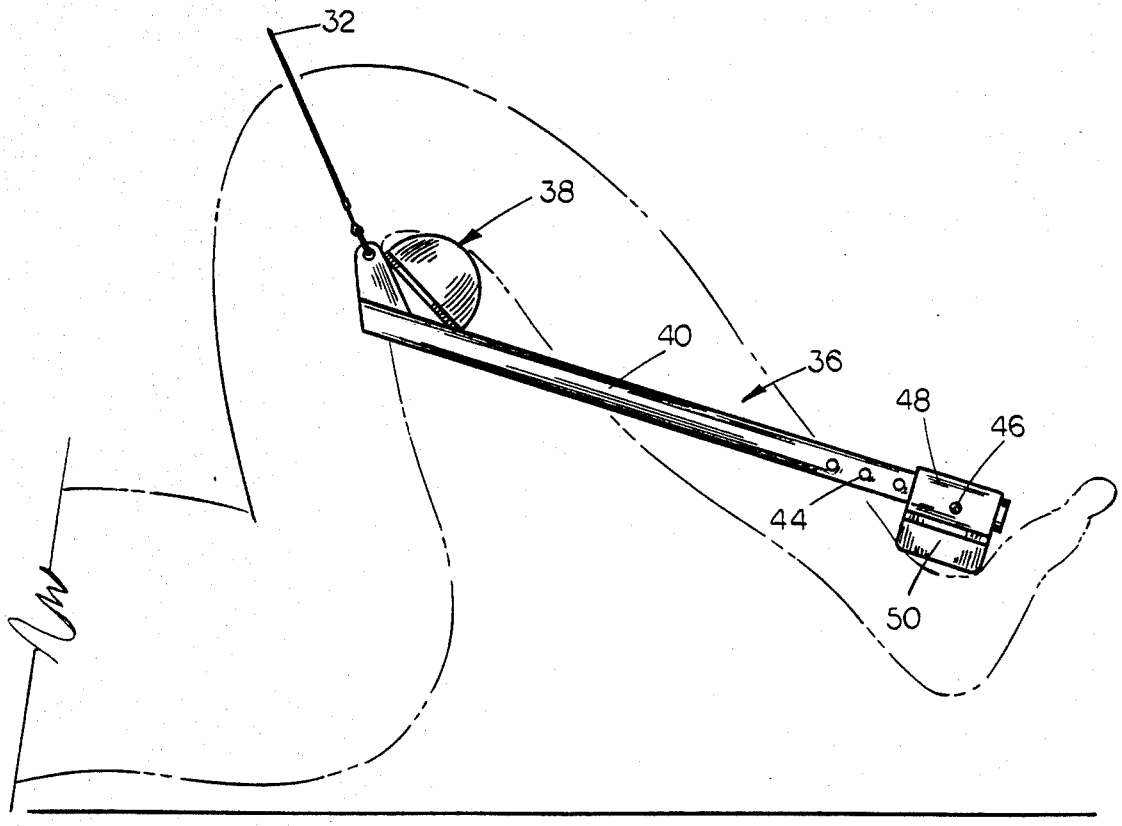
FIG. 4 is a side view illustrating the knee and ankle mechanism in use with the patient being shown in phantom.
Figure 5:
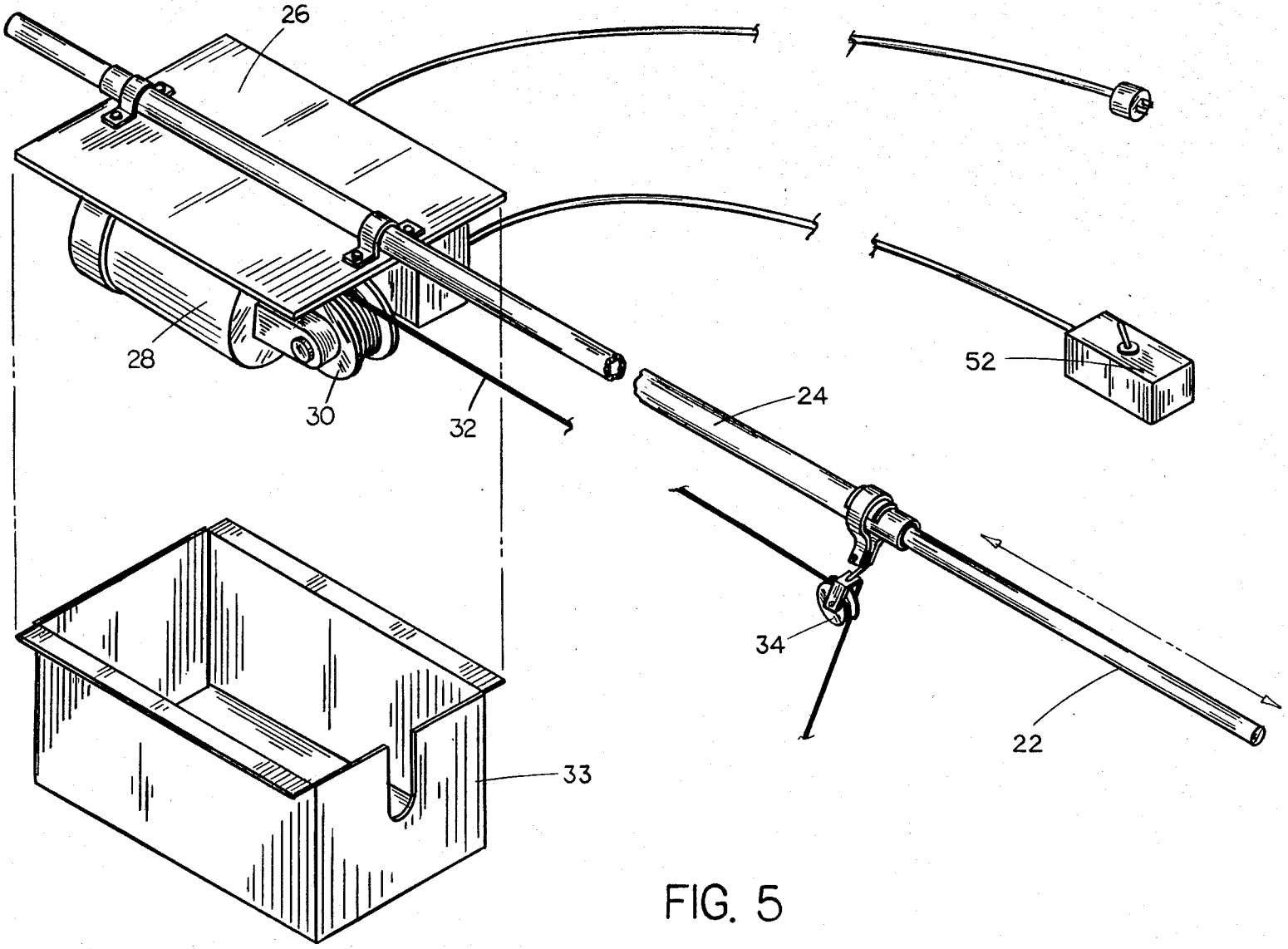
FIG. 5 is a partial perspective view of the means for raising and lowering the knee and ankle supporting mechanism.

A knee and ankle supporting mechanism 36 is secured to the lower end of cable 32 and includes a transversely extending adjustably secured cushioned knee support 38 which is adapted to be positioned beneath the patient's knees. An elongated member 40 extends from knee support 38 and has a transversely extending ankle support 42 adjustably secured thereto. As seen in the drawings, elongated member 40 is provided with a plurality of longitudinally spaced holes 44 adapted to receive pin 46 extending through collar 48 provided on the ankle support 42. Ankle support 42 is provided with a layer of cushion material 50 thereon as seen in FIGS. 3 and 4.

Figure 2:
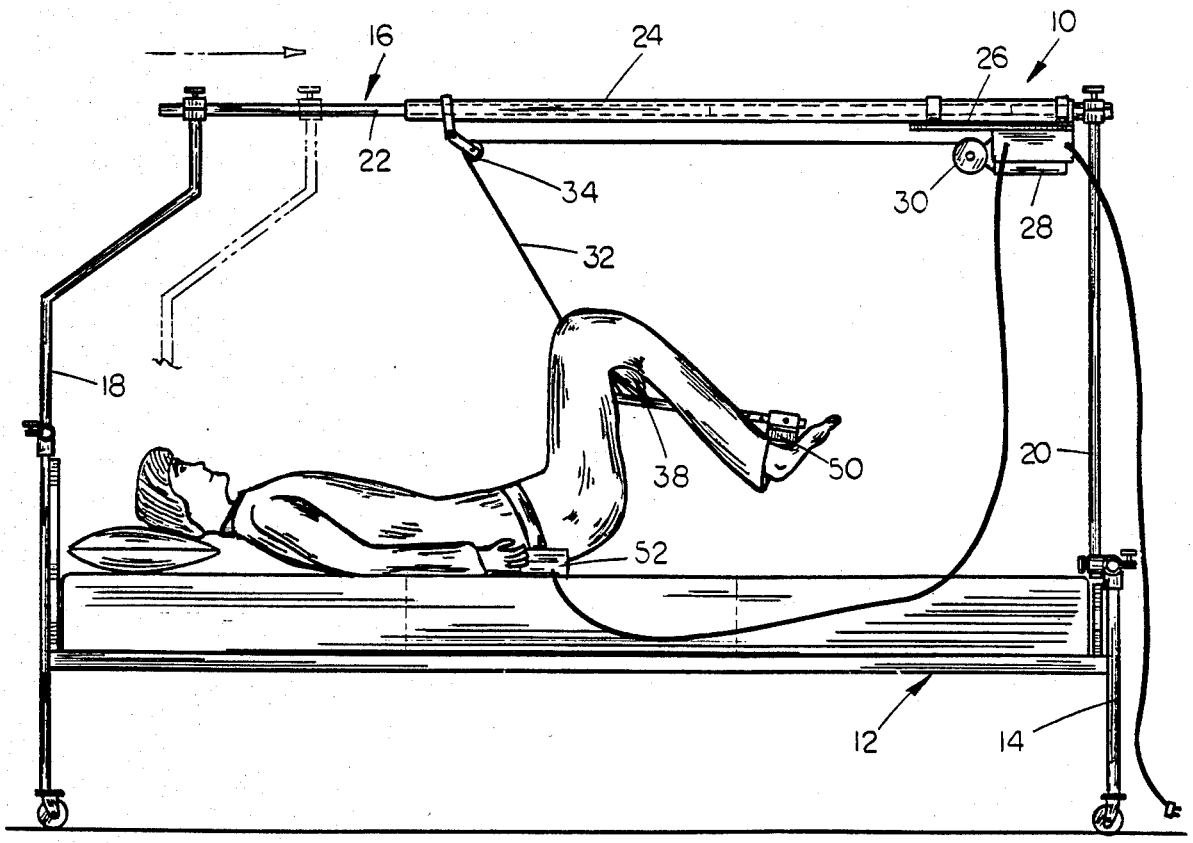
FIG. 2 is a side view of the flexion traction back relaxing system of the present invention.

In use, the patient is positioned on the bed in a substantially horizontal reclining position. The knee and ankle supporting mechanism 36 is positioned by the patient or attendant so that the knee support 38 is positioned beneath the patient's knees as best illustrated in FIGS. 1, 2 and 4. The ankle support 42 is longitudinally adjusted by the patient or attendant on elongated member 40 so that the ankle support will be positioned over the patient's ankles as seen in the drawings. The patient then operates the control box 52 to actuate gear motor 28 so that cable 32 will be wound upon the drum 30 thereby causing the knee and ankle support mechanism 36 to be raised. The knee and ankle supporting mechanism 36 is raised until the thighs of the patient are substantially vertically disposed and so that the buttocks of the patient have been slightly raised from the bed. The cushioned knee support 38 applies the necessary upward force on the underside of the knees and does not unreasonably interfere with circulation of the blood in the patient's legs if lifting is not maintained more than the recommended one to three minutes. The ankle support 42 likewise does not interfere with blood circulation by virtue of its position and prevents the patient's legs from disengaging from the knee and ankle supporting mechanism 36. Without the ankle support 42, the patient's feet would simply raise upwardly as upward pressure was applied to the knee support 38 so that the effective upward movement would be lost. The patient would suspend himself as previously described for one to three minutes maximum and it has been found that the type of suspension described herein does relax the lower back muscles and does alleviate lower back pain. The patient can raise and lower the knee and ankle supporting mechanism 36 as desired within the three minute limit to achieve the necessary relief from pain. Preferably, an automatic time release mechanism is associated with the gear motor which causes the drum 30 to unwind slowly after a maximum of three minutes thereby preventing the patient from being suspended longer than three minutes.

Thus it can be seen that a novel back relaxing system has been provided which is easily adaptable to most beds and which permits the patient to selectively control the operation thereof. Thus it can be seen that the back relaxing system of this invention accomplishes at least all of its stated objectives.

I claim:

1. A back traction and relaxing system for use on a patient lying on a supporting surface, comprising, a frame means positioned over the patient, a first pulley mounted on said frame means approximately over the patient's waist, a cable extending around said first pulley and downwardly therefrom towards the patient, a knee and ankle supporting mechanism secured to one end of said cable, power means operatively connected to said cable for longitudinally moving said cable whereby said knee and ankle supporting mechanism may be selectively raised and lowered, said knee and ankle supporting mechanism comprising a first transversely extending support secured at its center length to said one end of said cable adapted to be positioned beneath the patient's knees, an elongated member secured to the center length of said first support and extending therefrom towards the patient's feet, a second transversely extending support secured to said elongated member adapted to be positioned over the top of the patient's ankles whereby predetermined upward movement of said knee and ankle supporting mechanism, by said power means, will cause the patient's buttocks to be slightly raised from the supporting surface.

2. The system of claim 1 wherein said second support is longitudinally adjustably mounted on said elongated member.

3. The system of claim 1 wherein said first and second supports have upper and lower ends, the lower end of said first support being padded, the upper end of said second support being padded.

4. The system of claim 1 wherein said frame means is length adjustable.

5. The system of claim 1 wherein a control means is operatively connected to said power means for controlling the operation thereof, said control means being located adjacent the patient.

6. The system of claim 1 wherein said supporting surface comprises a bed, said frame means being secured to and supported by said bed.

7. The method of relieving back pain in a person, comprising the steps of:

(a) positioning the person in a supine position on a supporting surface;

(b) placing a support beneath the person's knees and over the person's ankles so as to prevent the patient's feet from raising upwardly as upward pressure is applied to said support;

(c) raising the support and the patient's knees, relative to said supporting surface, until the patient's buttocks have moved out of substantial engagement with said supporting surface so that the person's back is placed in flexion traction; and (d) lowering the support, after a predetermined length of time, to remove the flexion traction from the person's back.

* * * * *